US008591608B2

(12) United States Patent
Young et al.

(10) Patent No.: US 8,591,608 B2
(45) Date of Patent: Nov. 26, 2013

(54) GASIFIER ASH PROCESSING SUBSYSTEM

(75) Inventors: Matthew Young, Acton, MA (US); Steven Anthony, Waltham, MA (US); Stephen Armstrong, Andover, MA (US); Steven Chase, Hanover, MA (US)

(73) Assignee: MSW Power Corporation, Acton, MA (US)

( * ) Notice: Subject to any disclaimer, the term of this patent is extended or adjusted under 35 U.S.C. 154(b) by 1064 days.

(21) Appl. No.: 12/586,830

(22) Filed: Sep. 29, 2009

(65) Prior Publication Data

US 2011/0072722 A1 Mar. 31, 2011

(51) Int. Cl.
*C10J 1/207* (2012.01)
*B01J 7/00* (2006.01)

(52) U.S. Cl.
USPC ..... 48/76; 48/61; 48/127.9; 48/127.1; 48/197 R; 48/87; 48/202; 48/210; 48/62; 48/63; 48/66; 48/77; 110/185; 110/186; 110/191; 110/235; 110/226; 110/291; 110/298; 110/275; 110/273; 110/283

(58) Field of Classification Search
None
See application file for complete search history.

(56) References Cited

U.S. PATENT DOCUMENTS

| | | | | |
|---|---|---|---|---|
| 3,760,717 | A | 9/1973 | DeMilt et al. | |
| 3,790,091 | A | 2/1974 | Law et al. | |
| 3,910,775 | A | 10/1975 | Jackman et al. | |
| 3,949,036 | A | 4/1976 | Nelson | |
| 4,026,678 | A | 5/1977 | Livingston | |
| 4,203,374 | A * | 5/1980 | Frederick | 110/258 |
| 4,225,457 | A | 9/1980 | Schulz | |
| 4,445,906 | A | 5/1984 | Riemann et al. | |
| 4,557,204 | A | 12/1985 | Faehnle | |
| 4,859,211 | A | 8/1989 | Moore | |
| 5,230,716 | A * | 7/1993 | Notestein | 48/62 R |
| 5,407,809 | A | 4/1995 | Finn | |
| 5,428,906 | A | 7/1995 | Lynam et al. | |
| 5,431,702 | A | 7/1995 | Schulz | |
| 5,562,743 | A | 10/1996 | Daugherty et al. | |
| 5,656,248 | A | 8/1997 | Kline et al. | |
| 6,018,471 | A | 1/2000 | Titus et al. | |
| 6,506,223 | B2 | 1/2003 | White | |
| 7,108,788 | B2 | 9/2006 | Chang et al. | |
| 7,252,691 | B2 | 8/2007 | Philipson | |
| 7,685,737 | B2 | 3/2010 | Gorbell et al. | |
| 2002/0148917 | A1 * | 10/2002 | Koenig | 241/30 |
| 2006/0130396 | A1 | 6/2006 | Werner | |
| 2009/0090282 | A1 | 4/2009 | Gold et al. | |

OTHER PUBLICATIONS

U.S. Appl. No. 12/928,892, Young et al.
PCT Written Opinion of the International Searching Authority, PCT Application No. PCT/US08/11508, Jan. 8, 2009 (eight (8) pages).

* cited by examiner

*Primary Examiner* — Kaity V. Handal
(74) *Attorney, Agent, or Firm* — Iandiorio Teska & Coleman, LLP

(57) ABSTRACT

A gasifier includes a combustion zone where a gas is introduced and fuel is combusted and at least one sensor for measuring a predetermined condition in the gasifier. A grate subsystem contains the fuel and includes at least one grinding mechanism. A controller is responsive to the at least one sensor and controls the grinding mechanism by activating the grinding mechanism if the predetermined condition exists to reduce the collection of non-fuel products on the grate subsystem.

39 Claims, 6 Drawing Sheets

GASIFIER ASH PROCESSING SUBSYSTEM

FIELD OF THE INVENTION

The subject invention relates to gasifier systems and, in one particular example, gasifiers used in waste-to-energy systems.

BACKGROUND OF THE INVENTION

A typical gasifier includes a combustion zone for fuel (e.g., pellets) and a grate supporting the fuel bed during combustion. Ash falls through the grate and is collected in some fashion. When the fuel is of a predetermined composition, the grate can be very simple in design, e.g., a plate with holes or slots in it. Those skilled in the art have also devised rotating grates and grates which shake in order to encourage the ash to fall through the grate. See "State of the Art for Small Scale Gas Producer-Engine Systems" by Ali Kaupp first published by the German Appropriate Technology Exchange and reissued by the Biomass Energy Foundation Press, Golden, Colo. 80401 incorporated herein by this reference.

The applicant's co-pending application U.S. patent application Ser. No. 12/070,032 filed Feb. 14, 2008 discloses a new waste-to-energy method wherein feedstock waste is shredded, dried, and pelletized. The pellets are then combusted in a gasifier to produce a gas used to operate a generator which generates electricity. In such a waste-to-energy system, the composition of the fuel converted in the gasifier can vary widely. The feedstock waste, for example, may contain metal, ceramic, and/or other waste material which are not combustible in this process.

Such non-fuel products collect on the gasifier grate and impede the flow of gas through the gasifier. If the pressure drop along the reactor increases significantly, the result can be a dangerous "updraft" condition. In any case, the efficient operation of the gasifier depends on the correct pressure drop along the reactor.

Known shaking or other grates are ineffective at removing the non-fuel "clinkers" which collect on the grates. And, making the grate openings larger in size so that the clinkers pass through the grate considerably reduces yield because it allows for large, not fully converted feedstock to pass through. This defeats the purpose of the grate. Manually cleaning the grates of clinkers is inefficient as well since the gasifier must be shut down in order to do so. During the shut down period, no producer gas is produced.

BRIEF SUMMARY OF THE INVENTION

One aspect of the subject invention is to provide a gasifier with a new grate subsystem. In some examples, such a grate subsystem can reduce or eliminate clinkers and/or better maintain the correct pressure drop along the reactor. Preferably, the new grate subsystem properly contains the fuel feedstock and minimizes any waste of the feedstock.

In some examples, the new grate subsystem is fairly simple in design. It is also an object of the subject invention, in one embodiment, to provide such a new grate subsystem which reduces or eliminates the need to manually clear the grate of clinkers. One preferred grate subsystem better maintains the proper flow of gas through the gasifier.

The subject invention results from the partial realization that, in one example, a new grate subsystem for a gasifier includes a hopper with angled grates feeding clinkers to a pair of grinding shafts which grind the clinkers in order to maintain the correct pressure in the gasifier.

This invention features, in one embodiment, a gasifier comprising a combustion zone where a gas is introduced and fuel is combusted and at least one sensor for measuring a predetermined condition in the gasifier. A grate subsystem contains the fuel and includes at least one grinding mechanism. A controller is responsive to the sensor and controls the grinding mechanism. The controller is configured to activate the grinding mechanism if the predetermined condition exists to reduce the collection of non-fuel products on the grate subsystem.

In one example, the sensor is a pressure sensor responsive to the pressure below the grate subsystem. In one version, the grate subsystem includes at least two downwardly angled fixed grates defining a hopper area between the grates. The grinding mechanism then typically includes at least two spaced grinding shafts disposed in the hopper area. In one particular example, each shaft includes a gear meshed with a gear on the other shaft to drive the shafts together. A motor drives one shaft and the controller is configured to energize the motor.

One preferred subsystem includes two pairs of fixed downwardly angled grates defining two hopper areas. There are two pairs of spaced grinding shafts and one pair is disposed in each hopper area. In one particular design, each grate includes slots between 0.1 and 0.3 inches wide spaced between 0.5 and 0.8 inches apart and there is a gap of between 0.1 and 0.3 inches between the grinding shafts.

One preferred gasifier grate subsystem further includes a housing configured as a tray containing the grates and the grinding shafts. In one design, the tray includes spaced side members connected by spaced end members. Typically, the grinding shafts extend between the spaced end members. Bearings on each shaft rotatably couple the shafts to the end members.

One preferred controller is programmed to determine if a pressure output by the pressure sensor meets or exceeds a predetermined pressure and activates the grinding mechanism if the pressure meets or exceeds the predetermined pressure. The controller deactivates the grinding mechanism if the pressure does not meet or exceed the predetermined pressure. The controller may be further programmed to activate the grinding mechanism for increasing time intervals until the pressure does not meet or exceed the predetermined pressure.

The subject invention also features a gasifier grate subsystem comprising at least two downwardly angled fixed grates defining a hopper area between the grates, at least two spaced grinding shafts disposed in the hopper area, and a controller, responsive to a sensor, configured to actuate the grinding shafts if a predetermined condition exists to reduce the collection of non-fuel products on the fixed grates.

One gasifier grate control system in accordance with the subject invention features a grate subsystem for containing fuel in a gasifier. The grate subsystem includes at least one grinding mechanism and a controller, responsive to at least one sensor, for controlling the grinding mechanism. The controller is configured to actuate the grinding mechanism if a predetermined condition exists to reduce the collection of non-fuel products on the grate subsystem. The sensor may be a pressure sensor responsive to the pressure below the grate subsystem. The grate subsystem may include at least two downwardly angled fixed grates defining a hopper area between the grates and the grinding mechanism typically includes at least two spaced grinding shafts disposed in the hopper area.

The gasifier grate control system controller is preferably programmed to determine if the sensor output meets or exceeds the predetermined condition, activate the grinding mechanism if the sensor output meets or exceeds the predetermined condition, and deactivate the grinding mechanism if the sensor output does not meet or exceed the predetermined condition. The controller is preferably programmed to activate the grinding mechanism for increasing time intervals until the sensor output does not meet or exceed the predetermined condition.

The subject invention also features a gasifier comprising means for combusting fuel, sensor means for measuring a predetermined condition in the gasifier, a grate containing the fuel, and means for automatically removing clinkers on the grate in response to the sensed predetermined condition. In one embodiment, the means for automatically removing the clinkers includes at least one grinding mechanism activated by a controller responsive to the sensor means.

The subject invention also features a method of controlling a gasifier including a grate. One preferred method comprises detecting at least one gasifier condition indicative of clinkers on the grate and in response automatically activating a grinding mechanism to remove the clinkers. The grinding mechanism is deactivated when the gasifier condition no longer exists so that fuel is not ground and wasted.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
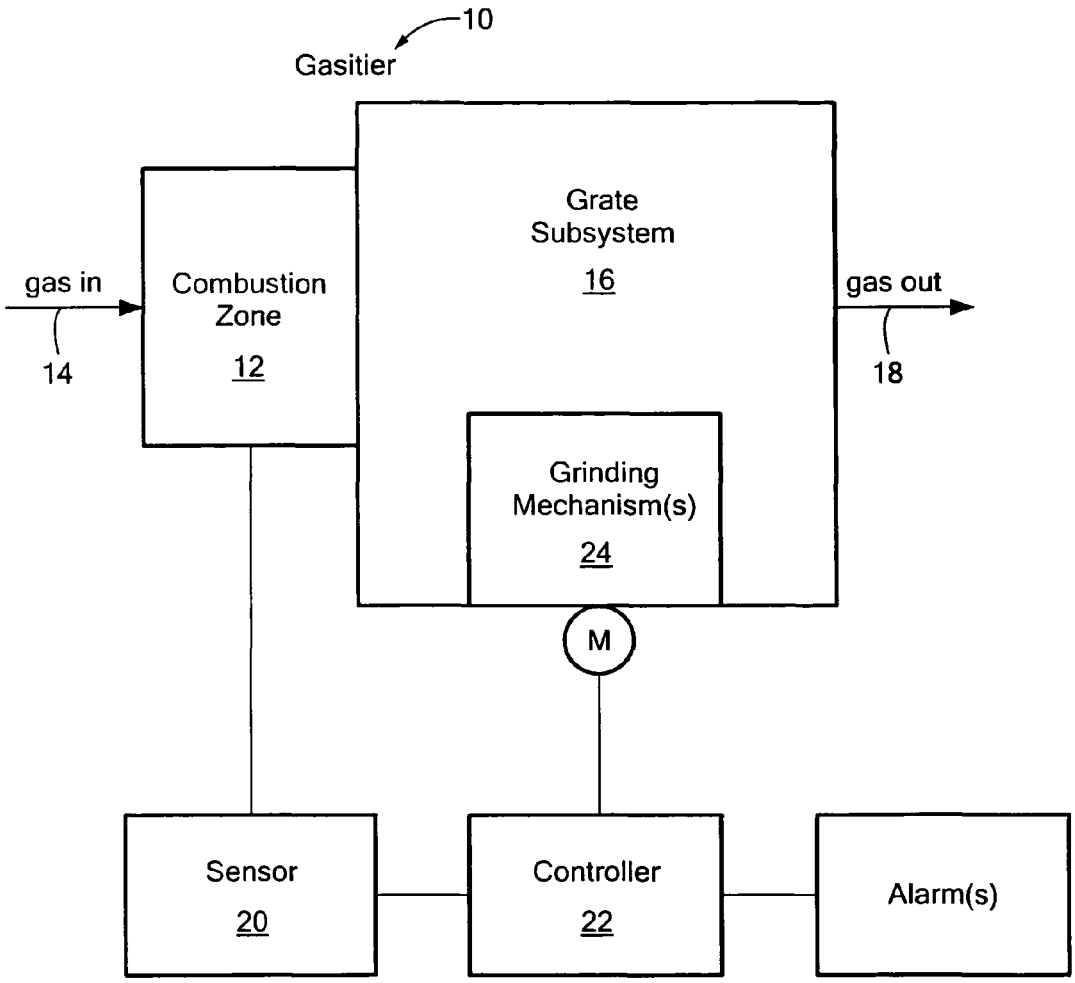
FIG. 1 is a highly schematic block diagram showing the primary components associated with an example of a gasifier in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows a gasifier 10 according to an example of the subject invention including combustion zone 12 where an oxidizer such as air is introduced as shown at 14 and where fuel is combusted. Grate subsystem 16 contains (e.g., supports) the fuel bed. The gas output of the gasifier as shown at 18 may be used, after conditioning, to generate electricity, to provide heat, and the like.

As noted in the background section above, it is important that the pressure drop through the gasifier 10 remains within specified parameters. Clinkers clogging the grate subsystem 16, for example, could increase the pressure to drop a level where an "updraft" condition occurs. And, in any case, the efficiency of the gasifier depends on the free flow of gas through the gasifier. When the fuel, e.g., pellets, is from an uncontrolled source, for example, the waste from a cafeteria or building, the likelihood of clinkers clogging the grate subsystem increases. The waste might include food and paper but also non-fuel products such as glass, metal, and ceramic materials.

Accordingly, the subject invention features a size reduction subsystem such as grinding mechanism 24 driven by motor M. The subject invention also features a sensor or sensor subsystem 20 for measuring a predetermined condition in the gasifier. In one preferred embodiment, sensor 20 is a pressure sensor providing an output to controller 22 which is responsive to the output of the pressure sensor and is configured (e.g., programmed) to determine if the pressure meets a predefined condition (e.g., a pressure indicating a potential "updraft" condition or a pressure indicating a low efficiency of the gasifier). Then, in response, controller 22 controls (e.g., energizes or activates) motor M of grinding mechanism 24 to rid the grate of clinkers. Controller 22 may be embodied in a computer, circuitry on a circuit board, a processor, an application specific integrated circuit, and the like.

Figure 2:
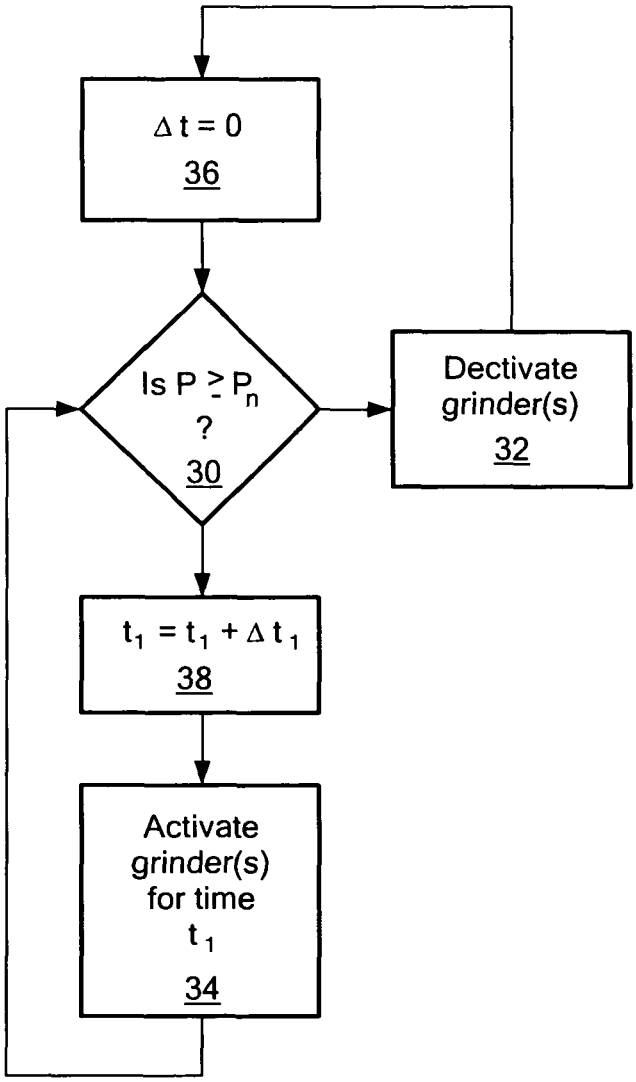
FIG. 2 is a flow chart depicting the primary steps associated with the operation of the controller component of the gasifier of FIG. 1.

As shown in FIG. 2, if controller 22 includes a processor or other programmable means, controller 22 is programmed to determine if the present pressure P (as detected by sensor 20, FIG. 1) is greater than or equal to a predetermined (or nominal operating) pressure Pn, step 30. If not, the grinder(s) are deactivated (if they were previously operating) step 32. When the pressure increases beyond Pn, however, the grinders are activated by the controller for a time period $t_1$, step 34 to clear the clinkers on the grate. That time period can be increased as shown at steps 36 and 38 between successive checks of the pressure. In this way, grinding occurs just long enough to clear the clinkers and return the system to the nominal operating pressure Pn but not longer than that because otherwise fuel, (e.g., pellets) might also be ground and wasted. Thus, the programming associated with controller 22, in one preferred embodiment, activates the grinder(s) just long enough to clear the clinkers off the grate and then deactivates the grinder(s).

Figure 3:
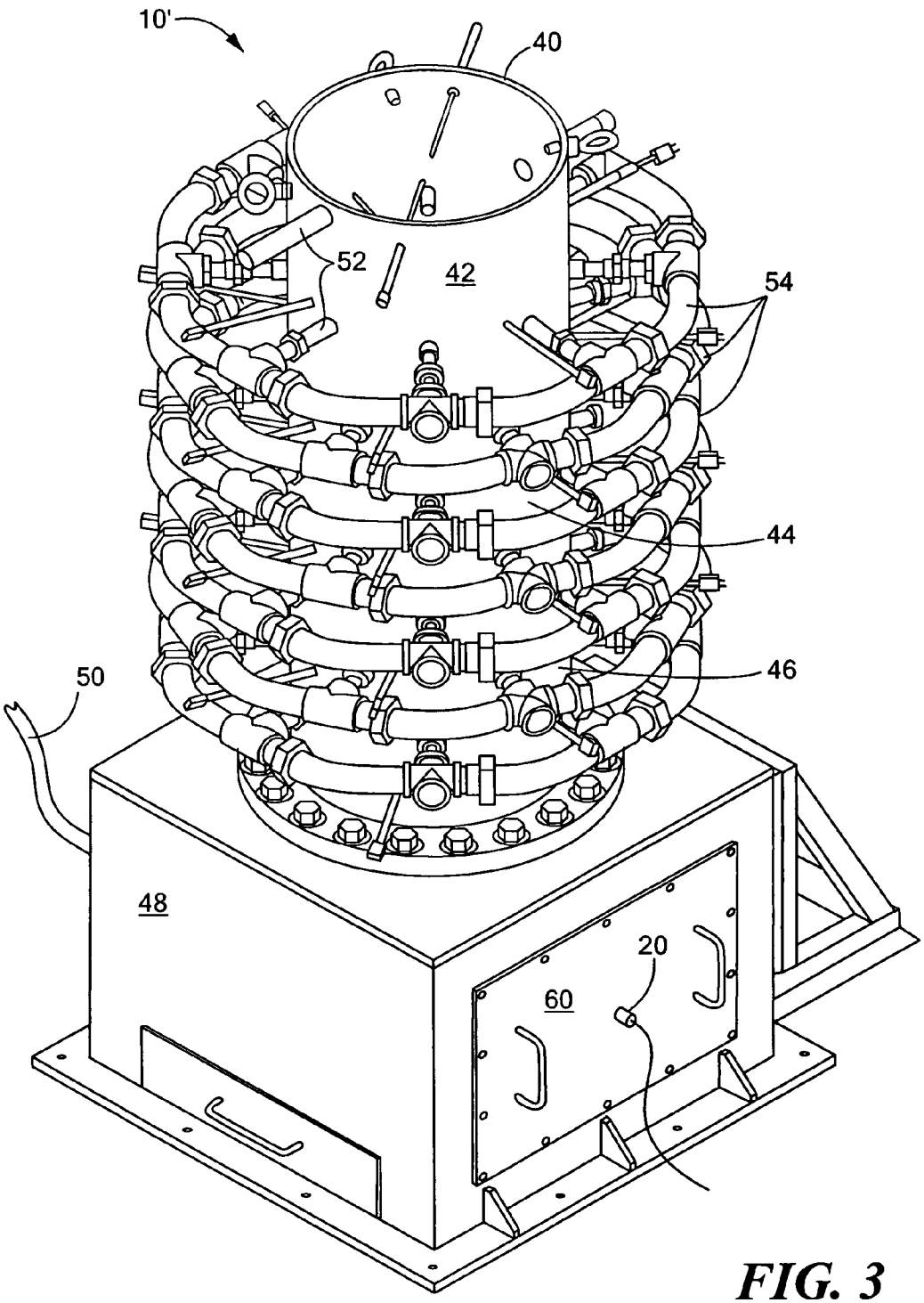
FIG. 3 is a schematic three-dimensional front view showing one preferred example of a gasifier in accordance with the subject invention.

Although this unique system will find uses in gasifiers of different designs and differing means for combusting fuel, FIG. 3 shows an example of gasifier 10 used in a waste-to-energy system where the feed stock is post consumer waste including food products from cafeterias and other food service establishments. Here, housing 40 is divided into several zones such as drying and distillation zone 42, combustion/reaction zone 44, and char reduction zone 46. Fuel (e.g., pellets) and primary air are introduced through the top of housing 40. Gas is output from grate area 48 via conduit 50. The pressure sensor discussed above is shown at 20. Sensors 52 are typically temperature sensors. Secondary air is provided by conduit system 54. The grate area 48, in this specific example, includes a tray-like feature 60 also shown in FIGS. 4-5.

Figure 4:
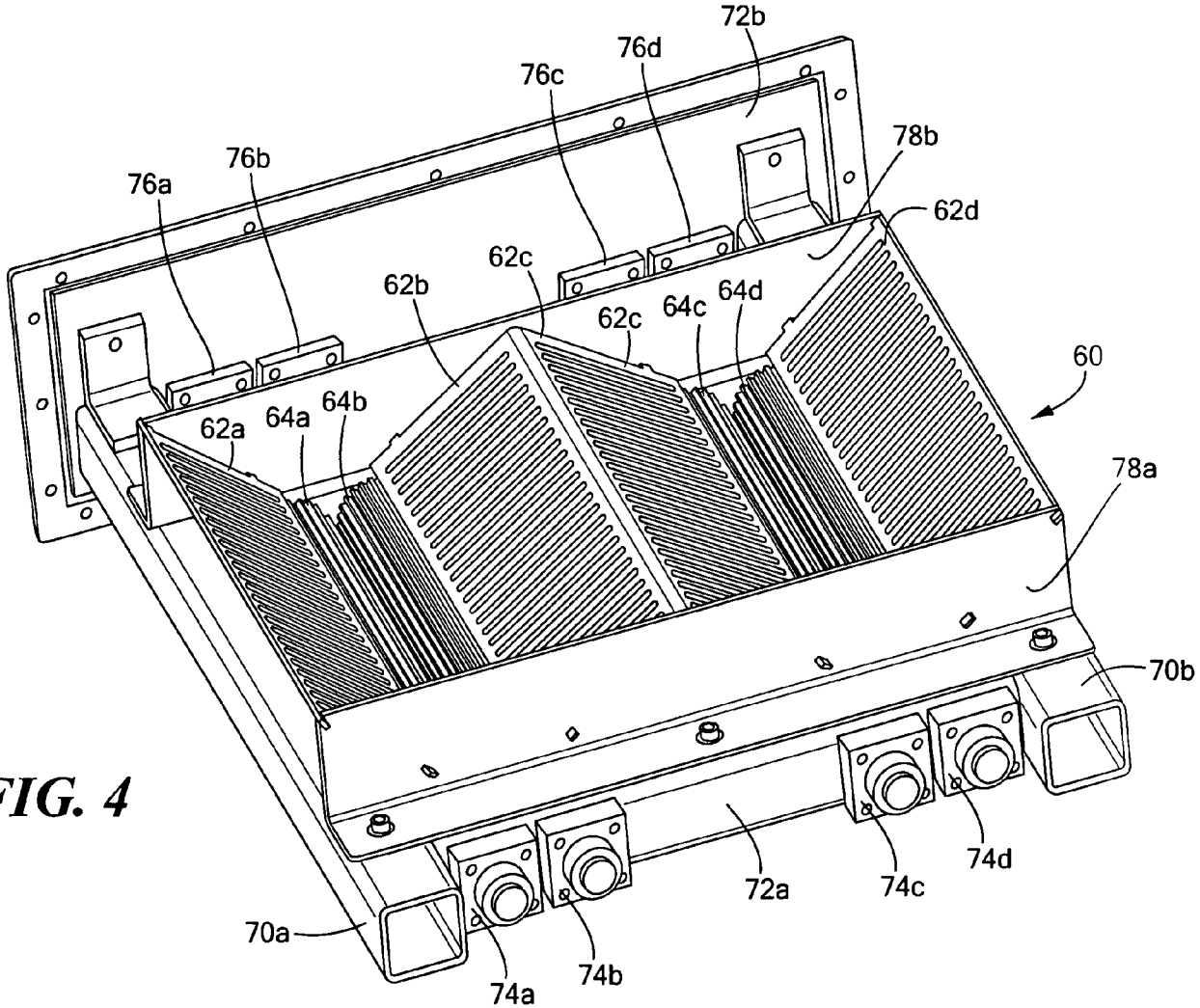
FIG. 4 is a schematic three-dimensional rear view of one example of a grate subsystem for the gasifier shown in FIG. 3.
Figure 5:
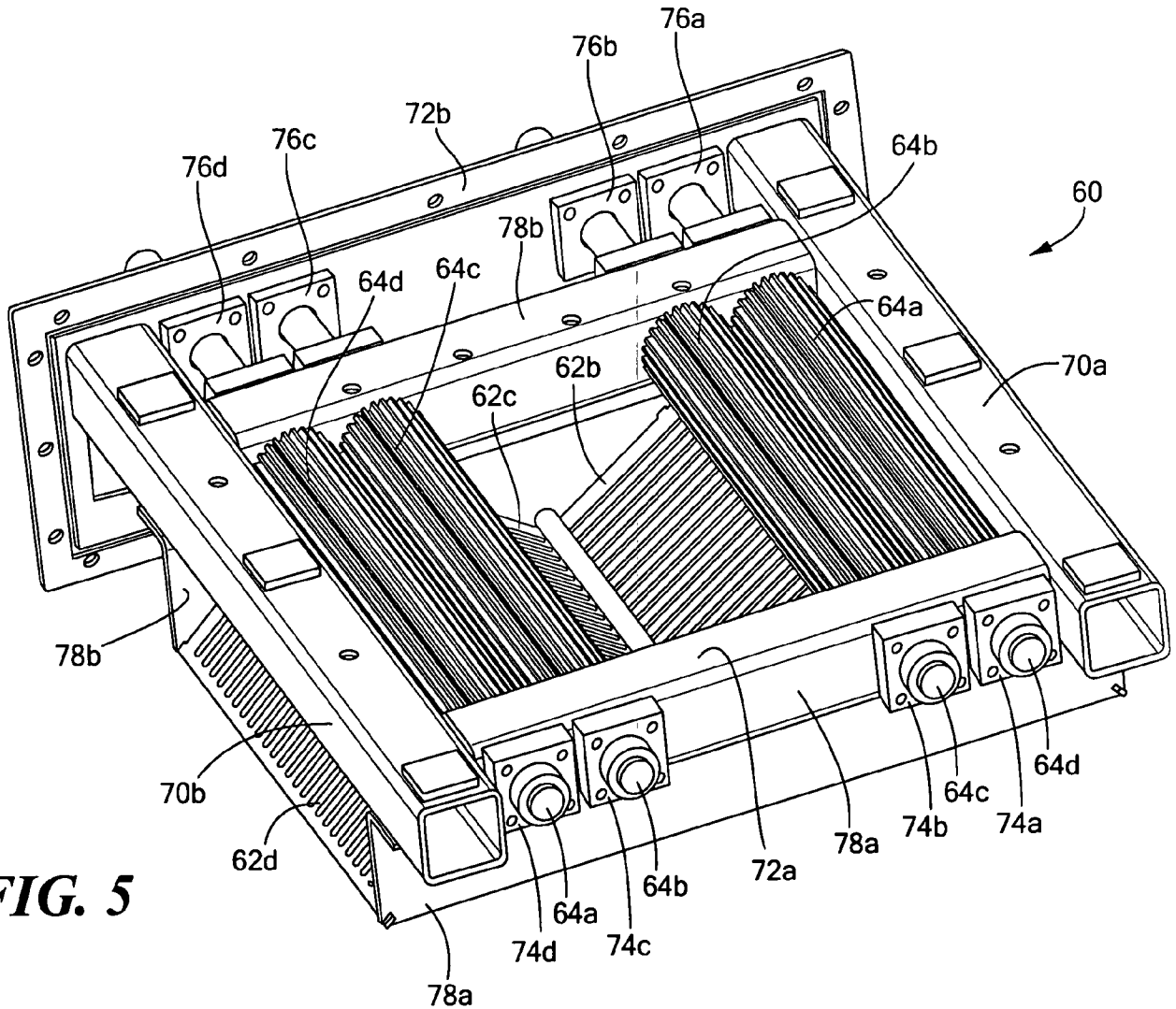
FIG. 5 is a schematic three-dimensional bottom view of the grate subsystem shown in FIG. 4.

Fixed grates 62*a*-62*d*, FIGS. 4-5 are all angled downwardly as shown and are arranged in pairs such that grates 62*a* and 62*b* form a hopper-like structure as do grates 62*c* and 62*d*. In this specific example, the clinker grinding mechanism includes a pair of spaced grinding shafts 64*a* and 64*b* between grates 62*a* and 62*b* and a pair of grinding shafts 64*c* and 64*d* between grates 62*c* and 62*d*.

Each fixed grate may be angled between 30° to 45° with respect to horizontal (angle θ in FIG. 4). The typical angle is 35°. The grates may be 0.375 inches thick stainless steel 18" to 19" long and between 6 and 7 inches wide. In one example, the plates were 18.26 inches long and 6.06 inches wide. Each grate typically includes numerous slots as shown to allow the ash to flow through the grates. The slots may be between 0.1 and 0.3 inches wide, between 9 and 12 inches long, and spaced between 0.5 and 0.8 inches apart. In one example, the slots were 0.22 inches wide and spaced 0.688 inches apart. The gap between the grinding shafts may be between 0.1 and 0.3 inches and the gap between each grinding shaft and the grate adjacent it may also be between 0.1 and 0.3 inches. 0.180 inches is typical. In one example, all of the gaps were 0.25 inches. These dimensions depend, however, on the pressure requirements, the fuel used, and the like, as well as the particular configuration of the gasifier.

To grind clinkers including metal, ceramic, and other hard materials, all the grate components are best made of stainless steel and grinding shafts 64*a*-64*d* are configured to grind such hard metals. Although this specific design includes two pairs of spaced downwardly angled grates and two pairs of grinding shafts, this is not a limitation of the subject invention. Other means for removing clinkers other than the grinders shown herein are within the scope of the subject invention. Size reduction devices other than grinders are possible.

The preferred tray structure 60 includes spaced side members 70*a* and 70*b* connected via spaced end members 72*a* and 72*b*. Grinding shaft 64*a* and 64*b* extend between spaced end members 72*a* and 72*b* as shown. This structure also defines an ash pit below grates 62*a*-62*d*. In one example, the grinding shafts were 3 inches in diameter and were made of Al tool steel. Bearings 74*a*-74*d* rotatably support one end of grinding shaft 64*a*-64*d*, respectively, with respect to end member 72*a*. Bearing blocks 76*a*-76*d* rotatably support the other end of grinding shaft 64*a*-64*d*, respectively, with respect to end member 72*b*. Spaced brackets 78*a* and 78*b* support the opposing ends of grate 62*a*-62*d*.

Figure 6:
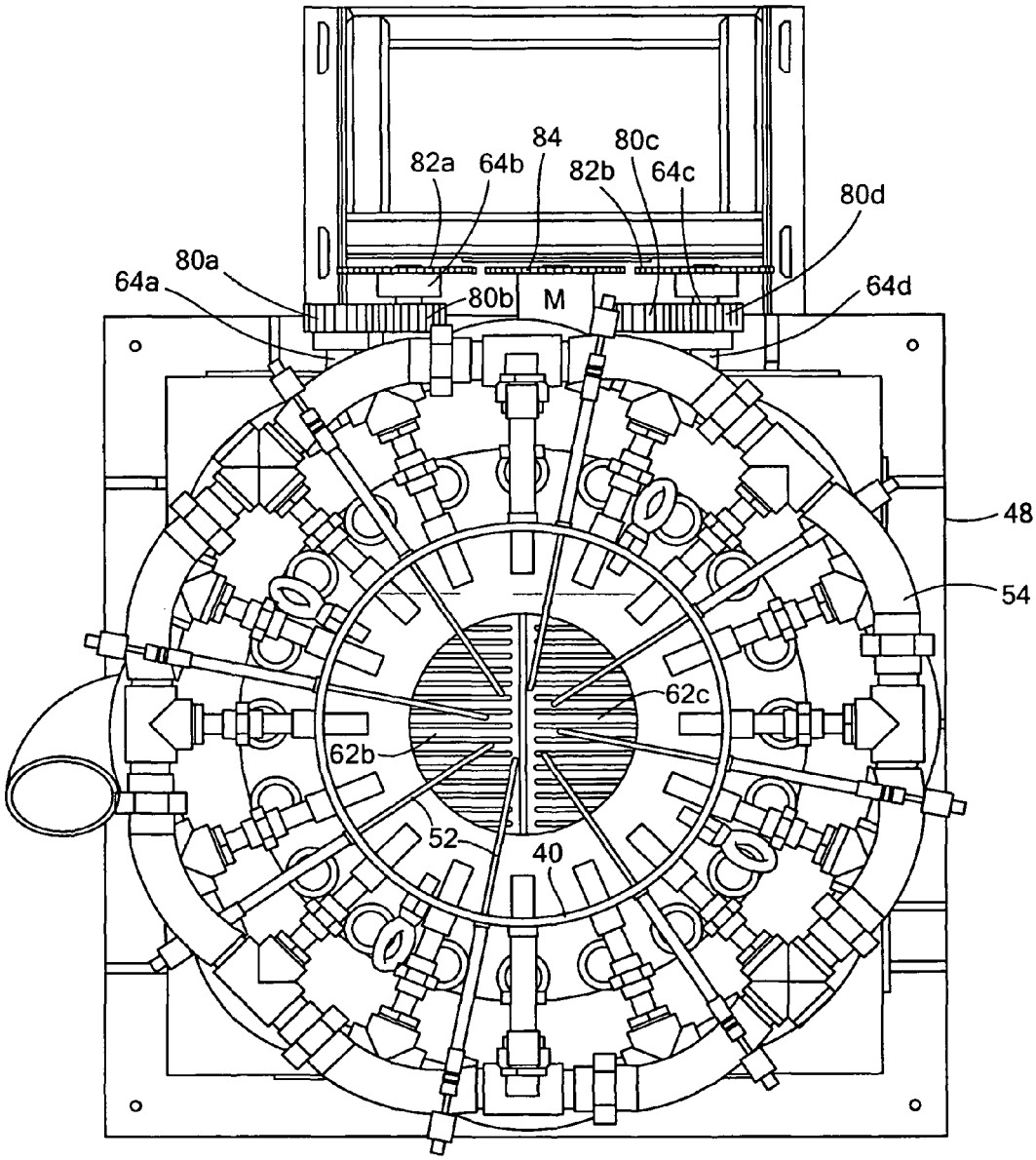
FIG. 6 is a schematic three-dimensional top view of the gasifier shown in FIG. 3.

FIG. 6 shows grates 62*b* and 62*c* within the gasifier configured with an apex between grates 62*b* and 62*c* centered on a diameter of housing 40. Grinding shafts 64*a* and 64*b* and 64*c* and 64*d* are driven together via gears 80*a* and 80*b*. Shafts 64*c* and 64*d* are driven together via gears 80*c* and 80*d*. Shafts 64*b* and 64*d* each include a gear 82, 82*b*, respectively, driven by a gear 84 on the output shaft of motor M (e.g., a high torque 1550 inch pound electric motor). In the case of a jam condition, motor M may provide an output signal to controller 22, FIG. 1 which will deenergize the motor and output an error message. Typically, the pressure sensor discussed above is disclosed below the grate structure. The area below the grates also defines an ash pit.

As discussed above, controller 22, FIG. 1, controls motor M, FIG. 6 based on the output of the pressure sensor. Motor M is energized and thus grinders 64*a* through 64*d* are driven whenever the pressure exceeds a predetermined pressure. When the pressure returns to normal, controller 22, FIG. 1 deenergizes motor M, FIG. 6. In this way, clinkers are removed from grates 62*a*-62*d*, FIGS. 4-6 and ash proceeds normally through the grates. Other means for automatically removing clinkers present on the grates are within the scope of the subject invention.

The result, in the preferred embodiment, is a new grate subsystem for a gasifier. Clinkers are reduced or even eliminated. The correct pressure is maintained in the gasifier. There is a reduction or even an elimination of the need to manually clear the grates of clinkers.

But, although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A gasifier comprising:

a combustion zone where a gas is introduced and fuel is combusted;

at least one sensor for measuring a predetermined condition in the gasifier;

a grate subsystem for containing the fuel, the grate subsystem including at least one grinding mechanism between downwardly angled grates defining a hopper; and a controller, responsive to the at least one sensor, for controlling the grinding mechanism, the controller configured to:

control the grinding mechanism if the predetermined condition exists to reduce the collection of non-fuel products on the grate subsystem.

2. The gasifier of claim 1 in which the sensor is a pressure sensor.

3. The gasifier of claim 2 in which the pressure sensor is responsive to the pressure below the grate subsystem.

4. The gasifier of claim 2 in which the controller is programmed to:

determine if a pressure output by the pressure sensor meets or exceeds a predetermined pressure, activate the grinding mechanism if the pressure meets or exceeds the predetermined pressure, and deactivate the grinding mechanism if the pressure does not meet or exceed the predetermined pressure.

5. The gasifier of claim 4 in which the controller is further programmed to activate the grinding mechanism for increasing time intervals until the pressure does not meet or exceed the predetermined pressure.

6. The gasifier of claim 1 in which the grinding mechanism includes at least two spaced grinding shafts disposed in the hopper area.

7. The gasifier of claim 6 in which each shaft includes a gear meshed with a gear on the other shaft to drive the shafts together.

8. The gasifier of claim 7 in which the grate subsystem further includes a motor for driving a said shaft.

9. The gasifier of claim 8 in which the controller is configured to energize the motor.

10. The gasifier of claim 6 in which each grate includes slots between 0.1 and 0.3 inches wide spaced between 0.5 and 0.8 inches apart and there is a gap of between 0.1 and 0.3 inches between the grinding shafts.

11. The gasifier of claim 6 in which the grate subsystem further includes a housing configured as a tray containing the grates and the grinding shafts.

12. The gasifier of claim 11 in which the tray includes spaced side members connected by spaced end members.

13. The gasifier of claim 12 in which the grinding shafts extend between the spaced end members.

14. The gasifier of claim 13 further including bearings on each shaft rotatably coupling the shafts to said end members.

15. The gasifier of claim 1 in which the grate subsystem includes two pairs of fixed downwardly angled grates defining two hopper areas.

16. The gasifier of claim 15 in which the grinding mechanism includes two pairs of spaced grinding shafts, one pair disposed in each hopper area.

17. A gasifier grate subsystem comprising:

at least two downwardly angled fixed grates defining a hopper area between the grates;

at least two spaced grinding shafts disposed in the hopper area; and a controller, responsive to a sensor, configured to control the grinding shafts if a predetermined condition exists to reduce the collection of non-fuel products on the fixed grates.

18. The gasifier grate subsystem of claim 17 in which each shaft includes a gear meshed with a gear on the other shaft to drive the shafts together.

19. The gasifier grate subsystem of claim 18 in which the grate subsystem further includes a motor for driving a said shaft.

20. The gasifier grate subsystem of claim 18 in which the controller is configured to energize the motor.

21. The gasifier grate subsystem of claim 17 in which the grate subsystem includes two pairs of fixed downwardly angled grates defining two hopper areas.

22. The gasifier grate subsystem of claim 21 in which there are two pairs of spaced grinding shafts, one pair disclosed in each hopper area.

23. The gasifier grate subsystem of claim 17 in which each grate includes slots between 0.1 and 0.3 inches wide spaced between 0.5 and o.s inches apart and there is a gap of between 0.1 and 0.3 inches between the grinding shafts.

24. The gasifier grate subsystem of claim 17 further including a housing configured as a tray containing the grates and the grinding shafts.

25. The gasifier grate subsystem of claim 24 in which the tray includes spaced side members connected by spaced end members.

26. The gasifier grate subsystem of claim 25 in which the grinding shafts extend between the spaced end members.

27. The gasifier grate subsystem of claim 26 further including bearings on each shaft rotatably coupling the shafts to said end members.

28. A gasifier grate control system comprising:

a grate subsystem for containing fuel in a gasifier, the grate subsystem including at least one grinding mechanism between downwardly angled grates defining a hopper area; and a controller, responsive to at least one sensor, for controlling the grinding mechanism, the controller configured to actuate the grinding mechanism if a predetermined condition exists to reduce the collection of non-fuel products on the grate subsystem.

29. The gasifier grate control system of claim 28 in which the sensor is a pressure sensor.

30. The gasifier grate control system of claim 29 in which the pressure sensor is responsive to the pressure below the grate subsystem.

31. The gasifier grate control system of claim 28 in which the grinding mechanism includes at least two spaced grinding shafts disposed in the hopper area.

32. The gasifier grate control system of claim 31 in which the grate subsystem further includes a housing configured as a tray containing the grates and the grinding shafts.

33. The gasifier grate control system of claim 32 in which the tray includes spaced side members connected by spaced end members.

34. The gasifier grate control system of claim 33 in which the grinding shafts extend between the spaced end members.

35. The gasifier grate control system of claim 28 in which the controller is programmed to:

determine if the sensor output meets or exceeds the predetermined condition, activate the grinding mechanism if the sensor output meets or exceeds the predetermined condition, and deactivate the grinding mechanism if the sensor output does not meet or exceed the predetermined condition.

36. The gasifier grate control system of claim 35 in which the controller is further programmed to activate the grinding mechanism for increasing time intervals until the sensor output does not meet or exceed the predetermined condition.

37. A gasifier comprising:

combusted;

a combustion zone where a gas is introduced and fuel is a grate subsystem for containing the fuel including downwardly angled grates defining a hopper area and including at least one grinding shaft proximate the hopper area; and a controller configured to control the grinding shaft.

38. A gasifier grate control system comprising:

a grate subsystem for containing fuel in a gasifier, the grate subsystem including downwardly angled grates defining a hopper area and at least one grinding mechanism proximate the hopper area; and a controller for controlling the grinding mechanism.

39. A gasifier grate control system comprising:

a grate subsystem for containing fuel in a gasifier, the grate subsystem including downwardly angled grates defining a hopper and at least two grinding shafts disposed below the hopper; and a controller for controlling the grinding shafts.

* * * * *